US008173254B2

(12) United States Patent
Hayashi et al.

(10) Patent No.: US 8,173,254 B2
(45) Date of Patent: May 8, 2012

(54) POLYESTER FIBER, WOVEN KNIT FABRIC, CAR SEAT AND PROCESS FOR PRODUCING POLYESTER FIBER

(75) Inventors: Tsuyoshi Hayashi, Mishima (JP); Yukinobu Maesaka, Mishima (JP); Hiroyuki Kurokawa, Mishima (JP)

(73) Assignee: Toray Industries, Inc., Tokyo (JP)

( * ) Notice: Subject to any disclaimer, the term of this patent is extended or adjusted under 35 U.S.C. 154(b) by 0 days.

(21) Appl. No.: 12/310,983

(22) PCT Filed: Sep. 14, 2006

(86) PCT No.: PCT/JP2006/318233

§ 371 (c)(1),
(2), (4) Date: Aug. 18, 2009

(87) PCT Pub. No.: WO2008/032379

PCT Pub. Date: Mar. 20, 2008

(65) Prior Publication Data

US 2010/0016516 A1 Jan. 21, 2010

(51) Int. Cl.
*D02G 3/00* (2006.01)

(52) U.S. Cl. ..... 428/373; 428/374; 525/419; 525/437; 525/444

(58) Field of Classification Search ..... 428/373, 428/374; 525/419, 437, 444
See application file for complete search history.

(56) References Cited

U.S. PATENT DOCUMENTS 6,503,623 B1 * 1/2003 Oue et al. ..... 428/364

FOREIGN PATENT DOCUMENTS

| | | | |
|---|---|---|---|
| EP | 1 033 422 A1 | | 9/2000 |
| JP | 11-093021 | * | 4/1999 |
| JP | 11-093021 A | | 4/1999 |
| JP | 2001-348729 A | | 12/2001 |
| JP | 2002-061030 | * | 2/2002 |

* cited by examiner

*Primary Examiner* — David W Wu
*Assistant Examiner* — Robert Jones, Jr.
(74) *Attorney, Agent, or Firm* — Kubovcik & Kubovcik

(57) ABSTRACT

This invention is polyester fibers with an initial tensile resistivity of 15 to 38 cN/dtex, a elastic recovery rate of 70% or more after 20% elongation, and a self-shrinkage percentage of 0.3% to 1.4% after dry heat treatment at 160° C. The polyester fibers of this invention can be used to obtain a woven or knitted fabric resistant against repeated loads, excellent in surface softness and uniformity, and free from projections/recesses and curling. Since the woven or knitted fabric obtained from the polyester fibers of this invention are highly resistant against repeated loads, it can be suitably used as a car seat loaded with human bodies.

8 Claims, 5 Drawing Sheets

POLYESTER FIBER, WOVEN KNIT FABRIC, CAR SEAT AND PROCESS FOR PRODUCING POLYESTER FIBER

This application is a 371 of international application PCT/JP2006/318233, filed Sep. 14, 2006.

TECHNICAL FIELD

The present invention relates to polyester fibers exhibiting stable behavior after heat treatment and subsequent cooling. Especially, this invention relates to polyester fibers capable of providing a fabric suitable for a car seat.

BACKGROUND ART

Polyethylene terephthalate (hereinafter may be referred to as "PET") as polyester fibers has been being studied as major synthetic fibers owing to its high tenacity, good dyeability and productivity. PET fibers are useful not only for clothing but also for motor vehicles and have been mainly developed for car seats and ceiling materials. PET fibers are stable in the behavior after heat treatment, and in the heat treatment step as the final step for obtaining a woven fabric or knitted fabric (may be referred as "woven or knitted fabric" collectively), the fabric can be easily kept within the designed fabric width and little changes thereafter. Therefore, a fabric with stable quality can be obtained. Further, for the reason that fabrics that are raised for use as car seats, ceiling materials and the like look luxurious, fabrics are sometimes raised after heat treatment. Also in the raising treatment, PET fibers are likely to have stable quality.

Meanwhile, in the case where PET fibers are used as a car seat, there is a problem that the fabric remains drawn since it is repetitively loaded with human bodies. The reason is that the elastic recoverability of PET fibers is small, that is, the recovery rate after elongation is low.

Furthermore, since the initial tensile resistivity (also may be referred to as "Young's modulus" or "elastic modulus") of PET fibers is as high as about 90 cN/dtex, especially a raised fabric formed of them has a problem that it has a stinging hardness.

On the other hand, fibers formed of polytrimethylene terephthalate (hereinafter may be referred to as "3GT") are high in the elastic recoverability and low in the initial tensile resistivity and therefore have a feature of excellent softness. Since they have dyeability in addition, they are energetically studied in recent years as attractive polyester fibers capable of compensating the disadvantages of PET fibers.

However, 3GT fibers are not almighty either and also have disadvantages. To compensate the disadvantages, active studies are being made on 3GT fibers. For example, 3GT fibers have low tenacity, too low elastic modulus undesirable for some applications and low color fastness, and to compensate these disadvantages, core-sheath conjugate fibers using 3GT as the sheath component and PET as the core component are proposed (Patent Document 1). According to the document, core-sheath conjugate fibers with a tenacity of 3.9 to 4.7 g/d (3.5 to 4.2 cN/dtex) and an elastic modulus of 43 to 72 g/d (39 to 65 cN/dtex) can be obtained. This technique can certainly achieve a high tenacity compared with the conventional 3GT fibers but impairs the low elastic modulus that is the most important feature of 3GT fibers, causing the problem of losing softness. Further, the importantly attractive elastic recoverability of 3GT fibers greatly declines and only an unsatisfactory car seat can be obtained.

On the other hand, in the case where 3GT fibers are used as a car seat, if the state of tension is released after finish thermosetting, the seat gradually shrinks in the width direction because of the poor thermosetting property thereof, resulting in irregular quality in the transverse direction. Especially this trend is remarkable with a knitted fabric low in the force of constraining the fabric, and after the lapse of several days subsequent to thermosetting, the surface smoothness is lost to cause the problem of losing softness or the edges are curled to raise the problem of not allowing practical use.

Publicly known techniques for improving the problem of shrinkage of 3GT fibers include, for example, Patent Document 2. The document proposes to control thermal stress for the purpose of lowering the high shrinkage percentage of 3GT fibers for thereby further enhancing softness. The method of control is to spin at a high speed and to wind without heat treatment. However, this technique has been found to cause gradual shrinkage with the lapse of time, showing a poor thermosetting property, though the thermal shrinkage percentage and stress are low. The reason is that crystallization takes place gradually even after production of fibers because the crystallinity of the fibers obtained by high speed spinning is low and because 3GT has a low glass transition temperature.

As described above, fibers capable of providing a fabric suitable for a car seat have not been proposed so far.

Patent Document 1: JP11-93021 A (claims, paragraph [0011], examples)

Patent Document 2: JP2001-348729A (claims, examples)

DISCLOSURE OF THE INVENTION

Problem to be Solved by the Invention

This invention proposes polyester fibers capable of providing a woven or knitted fabric resistant against repeated loads, excellent in surface softness and uniformity, and free from projections/recesses and curling, particularly a fabric suitable for a car seat.

Means for Solving the Problem

This invention provides polyester fibers having an initial tensile resistivity of 15 to 38 cN/dtex, a elastic recovery rate of 70% or more after 20% elongation, a self-shrinkage percentage of 0.3% to 1.4% after dry heat treatment at 160° C.

Further, this invention includes a woven or knitted fabric formed of said fibers.

Further, this invention includes a car seat formed of said woven or knitted fabric.

Further, this invention includes a cheese-shaped package having said fibers wound therearound, with a bulge of −5 to 10% and a saddle of 0 to 10%.

Further, this invention includes a process for producing said polyester fibers.

Effect of the Invention

This invention provides polyester fibers having the low initial tensile resistivity and the high elastic recoverability of 3GT fibers and improved in the poor thermosetting property of 3GT fibers. The polyester fibers of this invention can be used to obtain a woven or knitted fabric resistant against repeated loads, excellent in surface softness and uniformity and free from projections/recesses and curling. Especially, car seats better than conventional car seats can be obtained.

MEANINGS OF SYMBOLS

Figure 1:
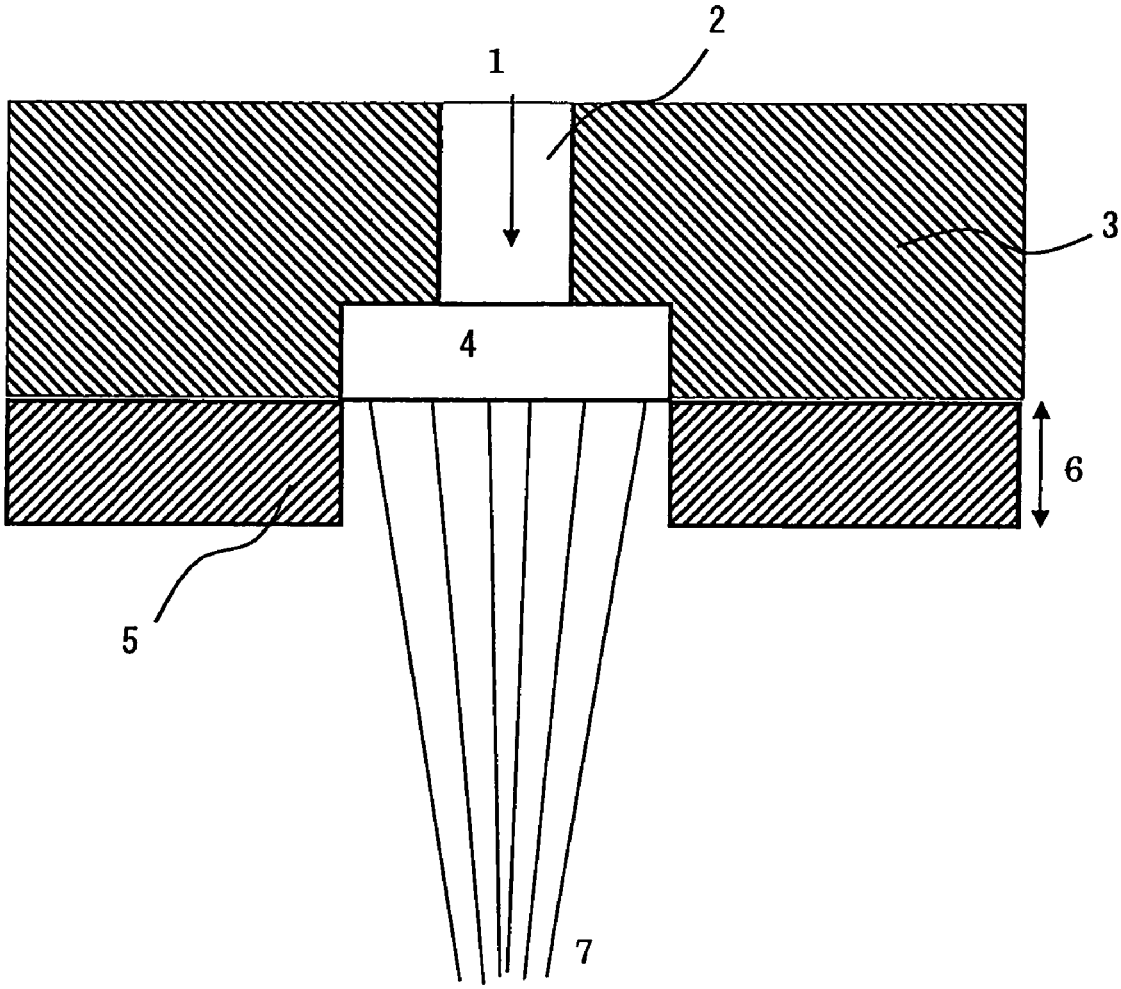
[FIG. 1] is a typical view showing the relation between a die and a die face depth.

1 . . . polymer 2 . . . pipe 3 . . . spinning heating body (spinning temperature) 4 . . . die 5 . . . warming body 6 . . . die face depth 7 . . . discharged polymer 8 . . . die 9 . . . cooling device 10 . . . oiling device 11 . . . entangling device 12 . . . first roller 13 . . . second roller 14 . . . contact roller 15 . . . package 16 . . . winder 17 . . . die 18 . . . cooling device 19 . . . oiling device 20 . . . entangling device 21 . . . first roller 22 . . . heating plate 23 . . . second roller 24 . . . contact roller 25 . . . package 26 . . . winder 27 . . . die 28 . . . cooling device 29 . . . oiling device 30 . . . entangling device 31 . . . first roller 32 . . . second roller 33 . . . entangling device 34 . . . third roller 35 . . . fourth roller 36 . . . contact roller 37 . . . package 38 . . . winder

THE BEST MODES FOR CARRYING OUT THE INVENTION

This invention is explained below in detail.

The polyester fibers of this invention have an initial tensile resistivity of 15 to 38 cN/dtex, a elastic recovery rate of 70% or more after 20% elongation, and a self-shrinkage percentage of 0.3% to 1.4% after dry heat treatment at 160° C. Satisfying these three properties is the feature of the polyester fibers of this invention, and such polyester fibers did not exist hitherto.

The initial tensile resistivity of the polyester fibers of this invention is 15 to 38 cN/dtex. If the initial tensile resistivity is in this range, the fabric obtained from the fibers has good softness. If the initial tensile resistivity of the fibers is larger than this range, the softness becomes poor. Since the widely used PET fibers have an initial tensile resistivity of about 90 cN/dtex, the fabric obtained from the PET fibers has a stinging hardness. The 3GT fibers studied in recent years have an initial tensile resistivity of about 20 cN/dtex, and this value is preferred. In view of the softness of the fabric, it is preferred that the initial tensile resistivity is lower. A more preferred range is 15 to 35 cN/dtex and a further more preferred range is 15 to 33 cN/dtex.

The elastic recovery rate of the polyester fibers of this invention after 20% elongation is 70% or more. In relation with the measuring method, the upper limit is 100%. If the elastic recovery rate is in this range, the fabric obtained from the fibers is good in the resistance against repeated loads. If the elastic recovery rate is too low, for example, the car seat obtained from the fibers remains drawn due to human body loads, and the threads forming the fabric are dislocated and loosened. The elastic recovery rate of PET fibers is about 30%, and a fabric formed of PET fibers only is inevitably low in the resistance against repeated loads. The elastic recovery rate of 3GT fibers is 90% or more, and the value is preferred. In view of the resistance against repeated loads, it is preferred that the elastic recovery rate is 80% or more, and further more preferred is 85% or more.

The initial tensile resistivity and the elastic recovery rate after 20% elongation of the polyester fibers can be controlled to some extent by selecting the polyester polymer used. It is preferred that the polyester polymer contains at least 3GT. Further, as required, another polyester polymer can be conjugated or blended. As the other polyester polymer, a polymer selected from PET and polybutylene terephthalate (hereinafter may be referred to as "PBT") is preferred.

The self-shrinkage percentage of the polyester fibers of this invention after dry heat treatment at 160° C. is 0.3 to 1.4%. The self-shrinkage percentage after dry heat treatment at 160° C. refers to the shrinkage caused by applying dry heat treatment to the fibers at 160° C. under a certain load and subsequently keeping them under gravity at room temperature after removing the load. Particularly, it refers to the value measured according to the following method.

A fiber is wound as a hank by 1 m×10 turns and is loaded with $9.1\times10^{-3}$ cN/dtex, and the hank length is measured (L0). Then, the hank is subjected to dry heat treatment at a load of $9.1\times10^{-3}$ cN/dtex and at 160° C. for 15 minutes, and immediately after completion of the dry heat treatment (within 30 seconds), the hank length is measured (L1). Further, the load is changed to $4.6\times10^{-3}$ cN/dtex, and the hank is allowed to stand at 20° C. for 30 minutes, to measure the hank length (L2). The self-shrinkage percentage after dry heat treatment at 160° C. is calculated from the following formula. (Self-shrinkage percentage after dry heat treatment at 160° C.)= (L1−L2)/L0

This loaded shrinkage rate is a parameter expressing the thermosetting property of fibers. If the self-shrinkage percentage of fibers is large, the fabric obtained from the fibers shrinks also after completion of finish thermosetting, to impair the uniformity of the fabric. Further, the shrinkage of a fabric causes the threads forming the fabric, for example, to be dislocated or loosened, lowering the surface appearance quality. Especially if the fabric is a knitted fabric low in the force of constraining the threads thereof, the effect is large and the fabric cannot be practically used. In order that the fibers can be used as a knitted fabric without any problem, it is necessary that the self-shrinkage percentage is 1.4% or less. More preferred is 1.1% or less. The loaded shrinkage rate is the most important item for enhancing the value as a fabric. The self-shrinkage percentage of PET fibers is about 0.3%, and that of conventional 3GT fibers is about 1.7 to about 2.0%

It is important that the polyester fibers of this invention simultaneously satisfy all the three items including the aforementioned initial tensile resistivity and the elastic recovery rate after 20% elongation. Conventional PET fibers can achieve the self-shrinkage percentage after dry heat treatment at 160° C., but could not satisfy the initial tensile resistivity or the elastic recovery rate after 20% elongation. Further, the conventional 3GT fibers could achieve the initial tensile resistivity and the elastic recovery rate after 20% elongation, but could not satisfy the self-shrinkage percentage after dry heat treatment at 160° C. The particular process for producing the polyester fibers of this invention satisfying all the three items is described below.

Next, preferred ranges of shrinkage properties of fibers are described below. The shrinkage properties of fibers are important in the subsequent process of obtaining a woven or knitted fabric. It is preferred that the boiling water shrinkage percentage of fibers is 4 to 11%, that the 160° C. dry heat shrinkage percentage is 4 to 15%, and that the temperature at a stress of 0.05 cN/dtex in the shrinkage-stress curve concerned is 55 to 80° C.

The boiling water shrinkage percentage is important as a yardstick for the shrinkage in the scouring step in the process for obtaining a woven or knitted fabric. It is preferred to keep the boiling water shrinkage percentage low, preferably in a range from 4 to 11%, since the fabric does not become hard. In the case of conventional 3GT fibers, the shrinkage percentage is about 13%. If the boiling water shrinkage percentage is large, the woven or knitted fabric shrinks to be hard in the scouring step and the like, and it is difficult to obtain a woven or knitted fabric having the softness of 3GT. It is more preferred that the boiling water shrinkage percentage is 4 to 10%, and a further more preferred range is 4 to 9.5%, since a fabric with excellent softness can be easily obtained.

The 160° C. dry heat shrinkage percentage is a yardstick for the shrinkage at the time of finish thermosetting. It is preferred that the 160° C. dry heat shrinkage percentage is kept rather low, and if it is 4 to 15%, the density of the threads forming the woven or knitted fabric can be easily controlled. Further, also in the case where the polyester fibers of this invention are woven or knitted together with other polyester fibers, since the difference in the shrinkage percentage between the polyester fibers of this invention and the other polyester fibers is small, the surface projections/recesses and curling of the fabric after heat treatment can be avoided. Also in view of softness, it is preferred that the 160° C. dry heat shrinkage percentage is lower. A more preferred range is 4 to 14%.

Further, the temperature at a stress of 0.05 cN/dtex in the shrinkage-stress curve concerned refers to the temperature at which stress begins to act when the fibers are heated at a heating rate of 100° C/min. The fabric is heated for the first time in the scouring step, and the temperature is 90 to 100° C. At this step, it is preferred that the temperature of the fibers at a stress of 0.05 cN/dtex is 55 to 80° C., since a good fabric can be easily obtained with the sudden shrinkage of the fabric inhibited and with the threads forming the fabric prevented from being dislocated. Further, it is preferred that the temperature of the fibers at a stress of 0,05 cN/dtex is 55° C. or higher, since the fibers being processed into a fabric are unlikely to be affected by the heat of the weaving machine or knitting machine. It is more preferred that the temperature of the fibers at a stress of 0.05 cN/dtex is 60° C. or higher. In the case of conventional 3GT fibers, this temperature is 45 to 55° C.

In addition, as a preferred property of the polyester fibers of this invention, it is preferred that the temperature at the peak shrinkage stress is 130 to 170° C. Further, it is preferred that the peak stress is 0.15 to 0.3 cN/dtex. In the case where these properties are in these ranges, since a moderate stress constantly acts in the direction to shrink the fibers till completion of finish thermosetting when the woven or knitted fabric is thermoset, the threads forming the fabric are not loosened, allowing a woven or knitted fabric with stable appearance quality to be obtained. It is more preferred that the temperature at the peak shrinkage stress is 140 to 160° C. and that the peak stress is 0.15 to 0.25 cN/dtex. The temperature at the peak shrinkage stress and the peak stress can be adjusted by adjusting the heat treatment temperature in the production of fibers and the fiber tension before and after the heat treatment.

It is only required that the tenacity and the elongation of fibers are set in the ranges not causing any problem when obtaining the fabric. It is preferred that the tenacity is 2.5 cN/dtex or more and that the elongation is 25 to 60%, since yarn breaking is unlikely to occur at the time of weaving or knitting.

The 3GT refers to a polyester obtained by using terephthalic acid as a main acid component and 1,3-propanediol as a main glycol component. It is preferred that 3GT contains 90 mol % or more of trimethylene terephthalate as recurring units. The 3GT may contain 10 mol % or less of another copolymer component. As examples of the copolymerizable compound, enumerated are dicarboxylic acids such as isophthalic acid, succinic acid, cyclohexanedicarboxylic acid, adipic acid, dimer acid, sebacic acid and 5-sodiumsulfoisophthalic acid and diols such as ethylene glycol, diethylene glycol, butanediol, neopentyl glycol, cyclohexanedimethanol, polyethylene glycol and polypropylene glycol, though not limited thereto. Further, as required, titanium dioxide as a delustering agent, fine silica particles or fine alumina particles as a lubricant, hindered phenol derivative as an antioxidant, color pigment and the like can also be added.

Further, PET refers to a polyester obtained by using terephthalic acid as a main acid component and ethylene glycol as a main glycol component. It is preferred that PET contains 90 mol % or more of ethylene terephthalate as recurring units. Like 3GT, a copolymer component as enumerated before can also be contained. Additives such as a delustering agent can also be added. Furthermore, PBT refers to a polyester obtained by using terephthalic acid as a main acid component and butylene glycol as a main glycol component. It is preferred that PBT contains 90% mol % or more of butylene terephthalate as recurring units. Also like 3GT, a copolymer component as enumerated before can also be contained. Additives such as a delustering agent can also be added.

It is preferred in view of softness and elastic recovery rate that the polyester fibers of this invention contain 3GT. Fibers consisting of 3GT (may be referred to as "3GT fibers") or fibers containing a polymer selected from PET and PBT in addition to 3GT can be used. In the case where PET or PBT is contained, so-called blended fibers obtained by spinning a blend consisting of multiple components can also be used. So-called conjugate fibers consisting of multiple components such as core-shell conjugate fibers or side-by-side conjugate fibers can also be used. If 3GT is blended or conjugated with PET or PBT, the good properties of 3GT such as softness and draw recover rate can be maintained while the disadvantages such as a poor thermosetting property of 3GT can be compensated. More preferred are concentric core-sheath conjugate fibers (may be referred simply as core-sheath fibers). Core-sheath fibers using a polymer selected from PET and PBT as the core component and 3GT as the sheath component are preferred, and core-sheath fibers using PET as the core component and 3GT as the sheath component are most preferred. In this case, it is preferred that the intrinsic viscosity of 3GT is 0.8 to 1.2 and that the intrinsic viscosity of PET is 0.4 to 0.6, since polyester fibers having the properties of 3GT and compensating the disadvantages of 3GT can be obtained. It is not preferred that the intrinsic viscosity of PET is higher than the range, since the properties of PET become so strong that the softness and elastic recovery rate of 3GT cannot be maintained. Meanwhile, in the case where PBT is used as the core component, it is preferred that the intrinsic viscosity of PBT is 0.5 to 0.9.

The polyester fibers of this invention are suitable for a woven or knitted fabric. If the fibers of this invention are used, a woven or knitted fabric resistant against repeated loads, excellent in surface softness and uniformity and free from projections/recesses and curling can be obtained. The woven or knitted fabric obtained from the polyester fibers of this invention can be suitably used for a car seat loaded with human bodies, since it is highly resistant against repeated loads. Meanwhile, a car seat may be raised to look luxurious. Since the polyester fibers of this invention are low in the initial tensile resistivity, the obtained fabric has excellent softness if it is raised. Meanwhile, in the case where the fabric is raised, since the front surface and the back surface of the fabric become different in state, such problems as curling are likely to occur. However, since the self-shrinkage percentage of the polyester fibers of this invention after dry heat treatment at 160° C. are low, curling and the like can be inhibited even if the fabric is raised. In this sense, the polyester fibers of this invention and the fabric obtained from them are the fibers and fabric most desired in the automobile industry.

In the case where a woven or knitted fabric is obtained from the polyester fibers of this invention, it is preferred that the woven or knitted fabric consists of the polyester fibers of this invention only and does not contain other fibers, since the properties of the polyester fibers of this invention can be exhibited to the maximum extent. However, other polyester fibers or natural fibers can also be conjugated or twisted together to such an extent that the effects of this invention are not impaired.

Figure 5:
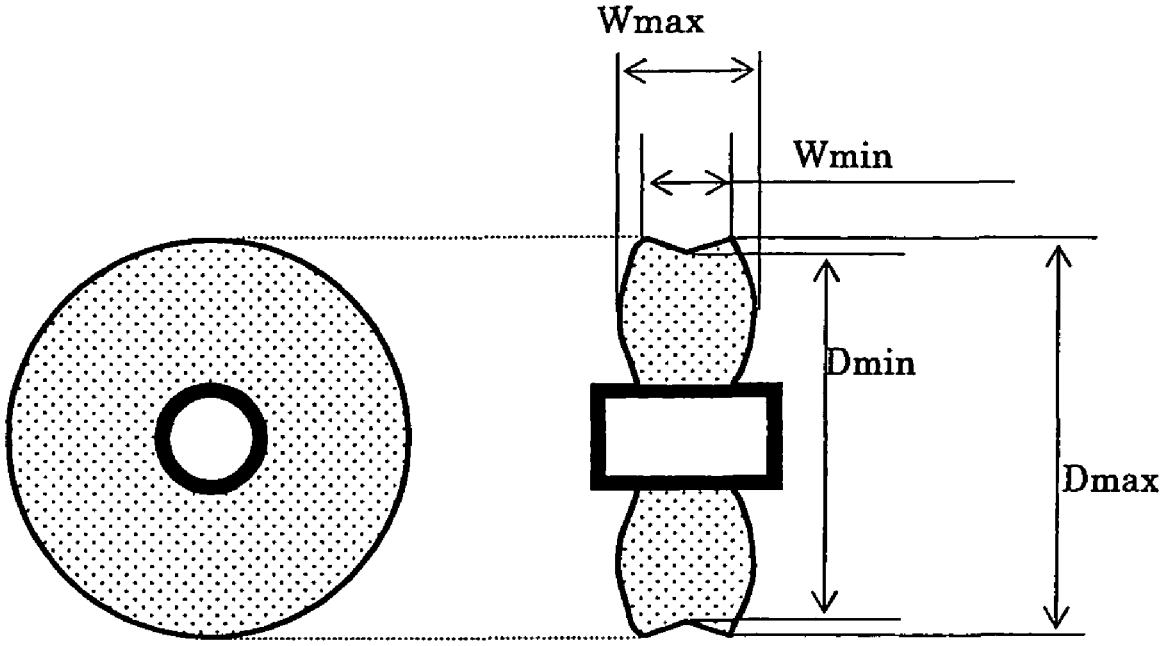
[FIG. 5] is a typical view for explaining a package and the bulge and saddle used as indicators of a package form.

The polyester fibers of this invention are wound around a paper tube or the like, to be supplied as a cheese-shaped package as shown in FIG. 5. It is preferred that the form of the cheese-shaped package is such that the bulge is −5 to 10% and that the saddle is 0 to 10%. As shown in FIG. 5, the maximum diameter (Dmax), the minimum diameter (Dmin), the maximum width (Wmax) and the minimum width (Wmin) of the package are measured, and the saddle and the bulge are calculated from the following formulae:

$$\text{Saddle (\%)}=\{(\text{Dmax}-\text{Dmin})/\text{Dmin}\}\times 100$$

$$\text{Bulge (\%)}=\{(\text{Wmax}-\text{Wmin})/\text{Wmin}\}\times 100$$

If the saddle and the bulge are large, the fibers in the package become irregular in hardness. Especially in the case where the saddle is large, the fibers are hard in the portion of the maximum diameter and on the contrary are likely to be soft in the portion of the minimum diameter. If the fibers are irregular in hardness, the uniformity of the fabric obtained by using the fibers is impaired, and the surface appearance quality of the fabric declines. If the saddle and the bulge are in the abovementioned ranges, the irregularity of the fibers in the package can be suppressed, and the decline of the surface appearance quality of the fabric caused by the irregularity can be inhibited. A more preferred range of bulge is 0 to 8% and a more preferred range of saddle is 0 to 8%.

For keeping the saddle and the bulge in the preferred ranges, it is important to keep good the form of the package immediately after completion of winding by keeping the tension at the time of winding in an appropriate range and also to lessen the change of the package form with the lapse of time after winding. Especially in the case of fibers containing 3GT, as described before, since the shrinkage with the lapse of time was likely to occur, the package was likely to be deformed. Since the shrinkage of the polyester fibers of this invention is small with the lapse of time after winding, the change in the package form after winding can be lessened, and the abovementioned preferred package form can be achieved.

A preferred process for producing the polyester fibers of this invention is described below.

One of preferred modes of the process for producing the polyester fibers of this invention is a process for producing polyester fibers comprising the step of melting polytrimethylene terephthalate polymer, the step of discharging from a die with a die face depth of 20 to 90 mm, the step of taking up the discharged polymer at a spinning speed of 4500 to 7000 m/min, and the step of heat-treating the taken up fibers at 120 to 180° C. without drawing. In this mode, 3GT fibers can be obtained.

In the case of 3GT fibers, it is preferred that the intrinsic viscosity of the 3GT polymer is 0.8 to 1.2. Further, it is preferred that 3GT polymer is molten to achieve a melt viscosity of 1000 to 2000 poises at a shear rate of 1216 $sec^{-1}$. It is preferred that the intrinsic viscosity is 0.8 or higher, since the shrinkage properties and softness of 3GT are good. Further, it is preferred that the intrinsic viscosity is 1.2 or lower for such reasons that the shrinkage of the obtained fibers is not too high and that spinning is also easy.

The polymer is molten generally by a method of using an extruder or pressure melter, but for securing the melt viscosity, a method of using an efficient extruder is preferred. Thereafter as shown in FIG. 1, the molten polymer 1 is weighed by a publicly known method and passes through a pipe 2, being discharged from a die 4. If the polymer retention time from the entry into the pipe to the discharge from the die is long, polymer deterioration occurs, and the melt viscosity declines. Especially since 3GT polymer is likely to be deteriorated by retention, it is preferred that the retention time from the entry into the pipe to the discharge from the die is kept at 20 minutes or less. Further, since the viscosity is lowered also by the spinning temperature, it is preferred that the spinning temperature is 275° C. or lower. Furthermore, to melt 3GT polymer sufficiently, it is preferred that the spinning temperature is 240° C. or higher.

Then, the polymer 7 discharged from the die 4 is cooled and solidified to form fibers. It is preferred that the die face depth 6 that affects the cooling solidification completion point is 20 to 90 mm. The die face depth of this invention refers to the distance from the die face to the bottom surface of a warming body 5. In general, if the die face depth is deeper, the tenacity of the fibers is enhanced due to the gradual cooling effect. However, in this invention, the die face depth is made shallow, and the molten polymer discharged from the die is cooled and solidified as quickly as possible so that the shrinkage of fibers can be inhibited and further that the thermosetting property can be improved. Furthermore in the case of 3GT, the temperature at which shrinkage stress begins to act during heating can be shifted upward, to enhance the surface appearance quality of the obtained fabric. If the die face depth is 100 mm, this effect cannot be found. The fibers cooled and solidified are bundled at the position of an oiling device. It is preferred that the bundling distance (the distance from the die face to the oiling device) is shorter. Since the die face depth is shallow, a short bundling distance and a lower spinning tension are most preferred for improving the thermosetting property. Particularly it is preferred that the bundling distance is 1000 to 1700 mm.

A shallower die face depth is preferred. A more preferred range is 20 to 80 mm, and a further more preferred range is 20 to 60 mm. However, a shallow die face depth can cool the die face, to lower the tenacity of fibers disadvantageously. Therefore, it is preferred to control the temperature of the warming body 5 below the die independently of the spinning temperature. That is, if the warming body 5 is kept at a temperature higher than the spinning temperature using a die heater, it can be avoided that the die face temperature declines. Particularly it is preferred to set the temperature of the warming body 5 at higher than the spinning temperature by 10 to 30° C. to keep the relation of (die face temperature)>(spinning temperature−10° C.), since the production of fibers with a low tenacity can be avoided (see FIG. 1).

Further, in this invention, it was found that if the spinning speed is made as high as 4500 to 7000 m/min and subsequently the taken up fibers are heat-treated at a high temperature of 120 to 180° C. without being drawn, then the shrinkage properties and the thermosetting property of the fibers are dramatically improved.

It is important to combine this high spinning speed and the shallow face depth, and since the fibers are sufficiently oriented by the spinning tension, the subsequent drawing is not required. A preferred spinning speed is 4500 to 7000 m/min, and a more preferred range is 5000 to 7000 m/min.

The spun fibers are heat-treated without being drawn. Since crystallization is promoted by heat without drawing, the thermosetting property of the fibers can be improved. For the heat treatment, either non-contact heat treatment by use of steam or the like or contact heat treatment by a roller or plate can be used. In view of thermal efficiency, contact heat treatment is preferred. To avoid the damage of fibers by abrasion, heat treatment by a roller is more preferred. It is preferred that the heat treatment temperature is 120 to 180° C., but for promoting thermal crystallization, a more preferred range is 140 to 180° C. Further, it is preferred in view of promotion of thermal crystallization that the heat treatment time is $20\times10^{-3}$ to $100\times10^{-3}$ second.

Figure 3:
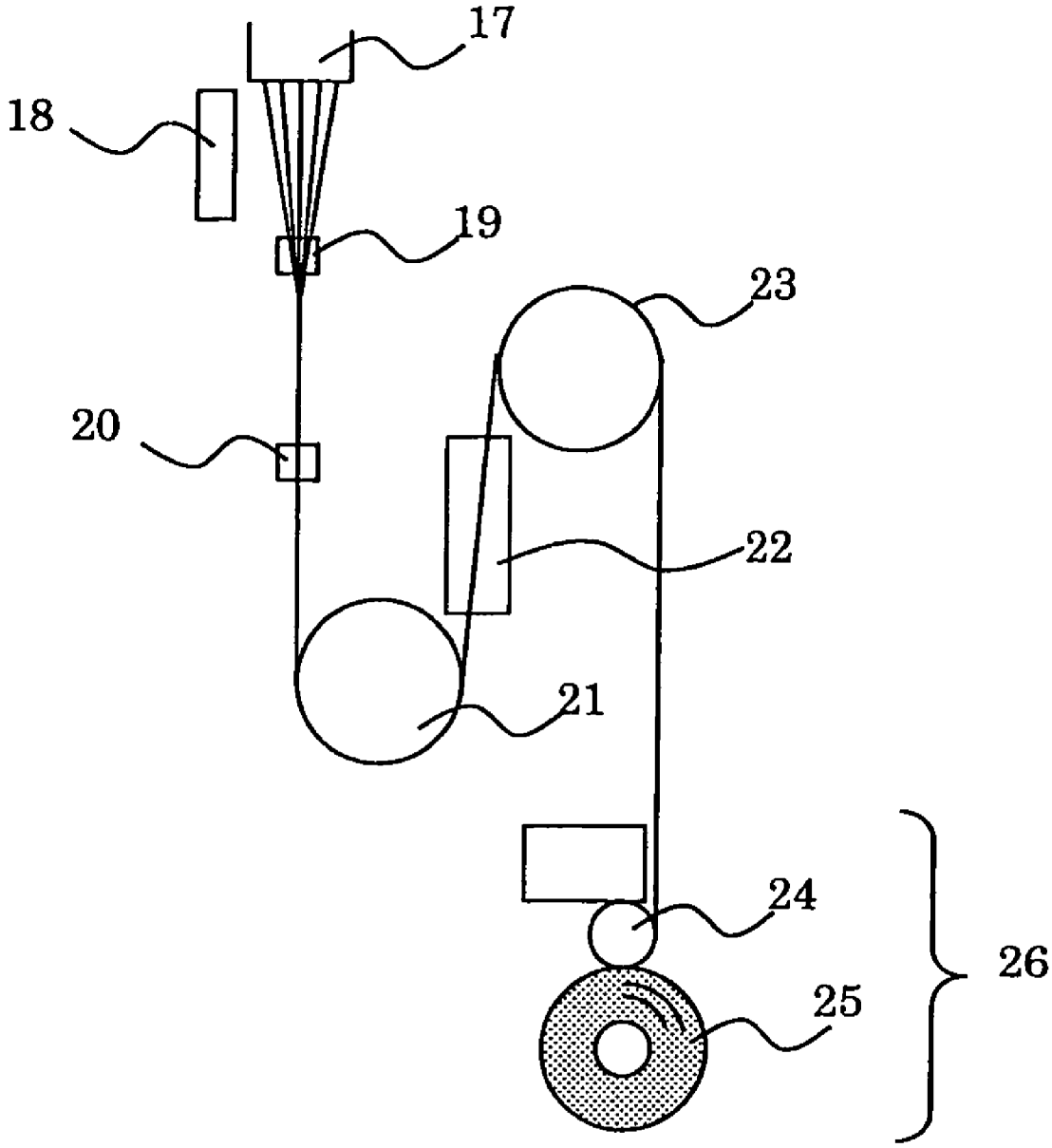
[FIG. 3] is a drawing showing another preferred example of equipment for producing 3GT fibers.

Moreover, to further improve the thermosetting property, it is effective to perform heat treatment in a state of tension. Particularly, a tapered roll is used as the heat treatment roller in such a manner that the roller outlet speed becomes higher than the roller inlet speed, to allow heat treatment in a state of tension. As another method, multiple rollers can be disposed and a heating plate 22 is installed between the rollers adjusted in speed, to allow tension heat treatment (see FIG. 3).

Another preferred mode of the process for producing the polyester fibers of this invention is a process for producing polyester fibers comprising the step of melting polytrimethylene terephthalate with an intrinsic viscosity of 0.8 to 1.2, the step of melting polyethylene terephthalate with an intrinsic viscosity of 0.4 to 0.6 or polybutylene terephthalate with an intrinsic viscosity of 0.5 to 0.9, the step of joining two molten polymers at a die, the step of discharging the joined polymers from the die with a die face depth of 20 to 90 mm, the step of taking up the discharged polymer at a spinning speed of 1400 to 3500 m/min, and the step of drawing and subsequently heat-treating the taken up fibers at 120 to 180° C. According to this process, fibers with preferred shrinkage properties can be obtained without increasing the spinning speed.

In this mode, conjugated fibers or blended fibers comprising 3GT and PET or PBT can be obtained. If a die for conjugated spinning such as a core-sheath die is used in the step of joining two molten polymers at a die and the step of discharging the joined polymers from the die, conjugated fibers can be obtained. On the other hand, if a mixer such as static mixer is used in the step of joining two molten polymers at a die and the step of discharging the joined polymers from the die, to mix the polymers and to subsequently discharge the mixture from the die, blended fibers can be obtained.

In these cases, as the 3GT polymer, it is preferred to select a polymer with an intrinsic viscosity of 0.8 to 1.2 to achieve a melt viscosity of 1000 to 2000 poises at a shear rate of 1216 $sec^{-1}$ as described before. On the other hand, as the PET polymer, it is preferred to select a polymer with an intrinsic viscosity of 0.4 to 0.6 to achieve a melt viscosity of 300 to 900 poises at a shear rate of 1216 $sec^{-1}$. Further, in the case of PBT polymer, it is preferred to select a polymer with an intrinsic viscosity of 0.5 to 0.9 to achieve a melt viscosity of 300 to 900 poises at a shear rate of 1216 $sec^{-1}$. For 3GT polymer, it is preferred to keep the retention time within 20 minutes as described before and to keep the spinning temperature as low as possible.

In the case of core-sheath fibers, it is preferred that the conjugation ratio between 3GT and the other polymer is such that the 3GT polymer rate in the fibers is 70 to 90 mass %. In the case of blended fibers, it is preferred that the blend ratio between 3GT polymer and the other polymer is such that the 3GT polymer rate in the fibers is 60 to 80 mass %. If the rate is kept in the range, the thermosetting property can be easily improved without impairing the advantages of 3GT.

In the case where 3GT polymer and PET polymer are used, since the melting point of PET is higher by 30° C. than the melting point 227° C. of 3GT, it is difficult to set the spinning temperature. However, a spinning temperature in a range from 265 to 275° C. is preferred. In the case where 3GT polymer and PBT polymer are used, since the melting point of PBT is not so different from that of 3GT, the spinning temperature can be set at the same temperature as that of 3GT fibers.

It is important to keep the melt viscosity of PET or PBT lower than that of 3GT. If the melt viscosity of PET or PBT is kept lower than the melt viscosity of 3GT, the initial tensile resistivity and the elastic recovery rate after 20% elongation as important properties of 3GT fibers can be maintained while the self-shrinkage percentage after dry heat treatment at 160° C. as a disadvantage of 3GT fibers can be kept low. That is, it was found that the conjugated fibers or blended fibers produced under this condition keep the nature of 3GT polymer dominantly in the initial tensile resistivity and the elastic recovery rate after 20% elongation and the nature of PET polymer or PBT polymer dominantly in the loaded shrinkage rate after dry heat treatment at 160° C. It is more preferred that the melt viscosity of PET polymer or PBT polymer is in a range from 400 to 800 poises. To keep the melt viscosity in this range, it is preferred that the intrinsic viscosity of PET polymer is in a range from 0.4 to 0.6 and that the intrinsic viscosity of PBT polymer is in a range from 0.5 to 0.9.

In the case of conjugated fibers or blended fibers, since the properties of fibers can be adjusted by combining polymers, a widely known production method of taking up the discharged polymers under widely known spinning conditions and drawing can be employed unlike the case of 3GT fibers. In the case of said 3GT fibers, since the production conditions are very different from the widely known production conditions, it may be difficult to use widely known production equipment as the case may be. Conjugated fibers or blended fibers are preferred since widely known production equipment can be used to obtain fibers with an excellent thermosetting property. Further, conjugated fibers or blended fibers are preferred, since the poor color fastness to light of 3GT can be compensated.

As described before, for improving the shrinkage properties and thermosetting property, it is preferred that the die face depth is 20 to 90 mm. A more preferred range is 20 to 80 mm, and a further more preferred range is 20 to 60 mm. Moreover, it is most preferred for achieving a higher thermosetting property that the bundling distance is kept at 1000 to 1700 mm and that the spinning tension is kept low as in the case of 3GT fibers.

It is preferred that the spinning speed is 1400 to 3500 m/min. If the spinning speed is in this range, stable spinning and appropriate tenacity can be obtained.

In succession to spinning and taking up, the fibers are drawn. The drawing ratio can be set arbitrarily in relation with the balance between tenacity and elongation. It is preferred that the elongation is set at 25 to 60%. For this purpose, it is preferred that the drawing ratio is set in a range from 1.2 to 4.5 times. It is preferred to preheat the fibers before drawing. After drawing, heat treatment is performed at 120 to 180° C. It is preferred that the heat treatment time is $20\times10^{-3}$ to $100\times10^{-3}$ second. This heat treatment promotes the crystallization of fibers, to improve the shrinkage properties and the thermosetting property.

Figure 4:
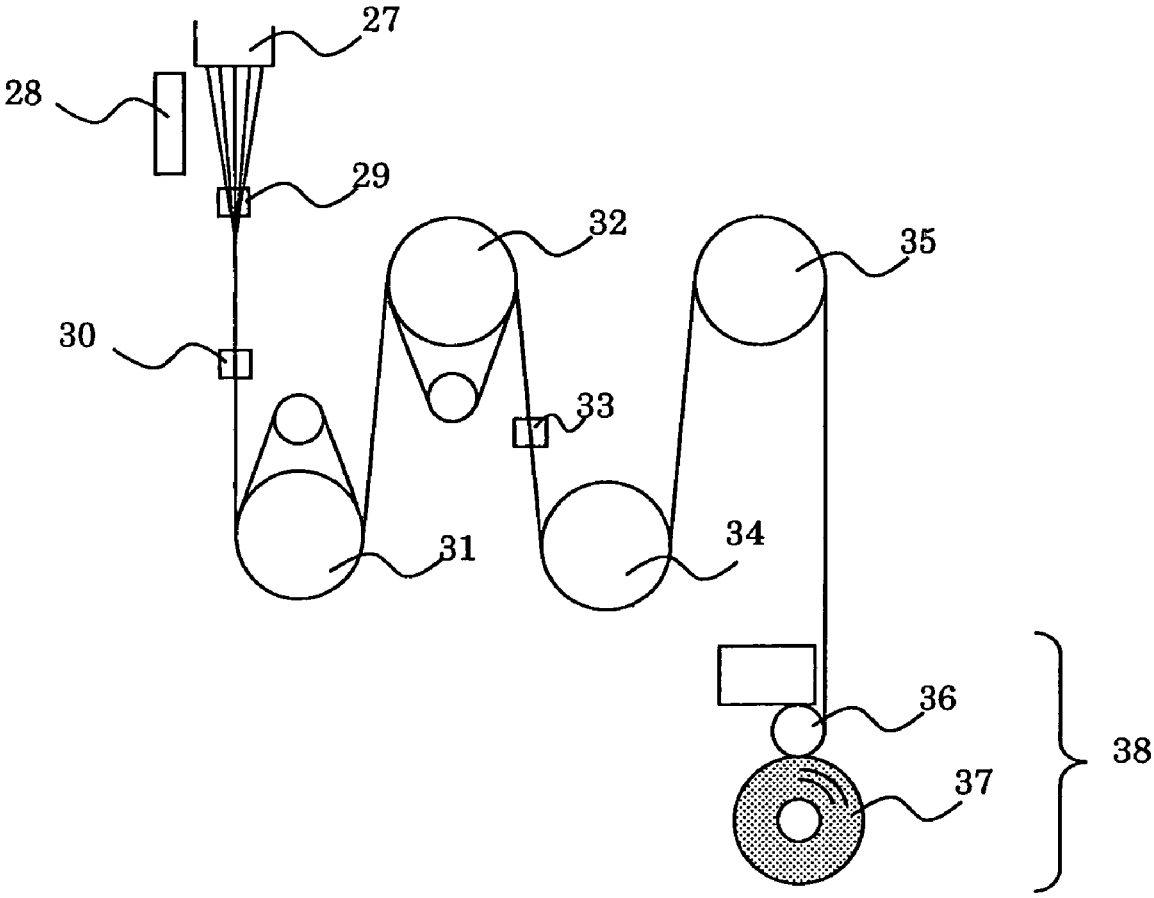
[FIG. 4] is a drawing showing a preferred example of equipment for producing 3GT core-sheath fibers or blended fibers.

As a more preferred process, after completion of heat treatment, the fibers are made to run along several rollers, for keeping the fiber cooling time longer than the heat treatment time and for adjusting the tension before being wound (see FIG. 4). This is preferred since the form of the package can be easily kept well.

Further, in both the cases of 3GT fibers and blended fibers or conjugated fibers, as a publicly known method, an oil may be given before the fibers are taken up by a roller and/or after the fibers are wound. Furthermore, to increase entangled fibers, entanglement can also be performed multiple times.

Moreover, in the case where the polyester fibers of this invention are used as a woven or knitted fabric, they may also be falsely twisted to be drawable.

EXAMPLES

This invention is explained below more particularly. Meanwhile, the main measured values in the examples were measured according to the following methods.

(1) Intrinsic Viscosity

The intrinsic viscosity [η] is the value obtained by measuring the viscosity at 30° C. using orthochlorophenol as the solvent and calculating from the following definition formula. In the following formula, C is the concentration of the solution and ηr is the relative viscosity (ratio of the viscosity of the solution with concentration C to the viscosity of the solvent).

$$[\eta] = \lim_{c\to 0}\frac{(\eta r - 1)}{c} \qquad \text{[Numerical formula 1]}$$

(2) Melt Viscosity

The melt viscosity was measured using Capilograph 1B produced by Toyo Seiki Seisaku-sho, Ltd. at a shear rate of 1216 $sec^{-1}$ in nitrogen atmosphere three times, and the average value was employed as the melt viscosity (poises). Meanwhile the measurement temperature was made equal to the spinning temperature in each example or comparative example, and the sample was held for the same period of time as the polymer retention time in each example or comparative example, before the melt viscosity was measured. That is, the melt viscosity of 3GT in Example 1 was measured using Capilograph 1B at a shear rate of 1216 $sec^{-1}$ after holding at a temperature of 270° C. for 15 minutes.

(3) Tenacity, Elongation, Initial Tensile Resistivity and Elastic Recovery Rate after 20% Elongation These properties were measured according to JIS L 1013 (1999). The tenacity and elongation were measured at a grip distance of 20 cm and a stress rate of 50%/min according to JIS L 1013 (1999) 8.5 "Tensile tenacity and elongation percentage." The initial tensile resistivity was measured at a grip distance of 20 cm and a stress rate of 50%/min according to JIS L 1013 (1999) 8.10. Further, as the elastic recovery rate after 20% elongation, the refractive index was measured at a grip distance of 20 cm and a stress rate of 50%/min after elongation the sample up to 20% according to JIS L 1013 (1999) 8.9 "elastic modulus method A."

(4) Self-Shrinkage Percentage after Dry Heat Treatment at 160° C.

A fiber was wound as a hank by 1 m×10 turns and was loaded with $9.1\times10^{-3}$ cN/dtex, and the hank length was measured (L0). Then, the hank was subjected to dry heat treatment at a load of $9.1\times10^{-3}$ cN/dtex and at 160° C. for 15 minutes, and immediately after completion of the dry heat treatment (within 30 seconds), the hank length was measured (L1). Further, the load was changed to $4.6\times10^{-3}$ cN/dtex, and the hank was allowed to stand at 20° C. for 30 minutes, to measure the hank length (L2). The self-shrinkage percentage after dry heat treatment at 160° C. was calculated from the following formula.

(Self-shrinkage percentage after dry heat treatment at 160° C.)=(L1−L2)/L0

(5) Boiling Water Shrinkage Percentage

A fiber was wound as a hank by 1 m×10 turns and was loaded with 0.029 cN/dtex, and the hank length was measured (L'0). Then, the hank was treated in 100° C. boiling water under no load for 15 minutes, dried in air, and subsequently loaded with 0.029 cN/dtex, when the hank length was measured (L'1). The boiling water shrinkage percentage was calculated from the following formula. Boiling water shrinkage percentage (%)={(L'0−L'1)/L'0}×100

(6) 160° C. Dry Heat Shrinkage Percentage

A fiber was wound as a hank by 1 m×10 turns and was loaded with 0.029 cN/dtex, and the hank length was measured (L"0). Then, the hank was treated in an oven of 160° C. under no load for 15 minutes, cooled in air, and subsequently loaded with 0.029 cN/dtex, when the hank length was measured (L"1). The 160° C. dry heat shrinkage percentage was calculated from the following formula.

160° C. dry heat shrinkage percentage (%){(L"0−L"1)/L"0}×100

(7) Temperature at peak shrinkage stress, peak shrinkage stress and temperature at stress of 0.05 cN/dtex A 200 mm sample was tied to form a ring, and the shrink stress was measured using KE-2 produced by Kanebo Engineering at an initial load of 0.044 cN/dtex, at an initial temperature of 30 C and at a heating rate of 100° C/min. The temperature at which the shrinkage stress became maximum (peak temperature) and the value of the shrinkage stress at the time (peak shrinkage stress) were obtained. Further, the temperature was chosen as the abscissa and the shrinkage stress was chosen as the ordinate, to draw a graph, for obtaining. the temperature at a stress of 0.05 cN/dtex.

(8) Saddle and Bulge

In each example or comparative example, fibers were wound around a paper tube with a diameter of 134 mm in a winding width of 114 mm, to obtain a package of 8 kg (winding diameter about 340 mm). The obtained package was allowed to stand in an atmosphere of 25° C. and 60% RH for 168 hours (7 days), and the form of the package was measured. As shown in FIG. 5, the maximum diameter (Dmax), minimum diameter (Dmin), maximum width (Wmax) and minimum width (Wmin) of the package were measured, and the saddle and the bulge were calculated from the following formulae.

Saddle (%)={(Dmax−Dmin)/Dmin}×100

Bulge (%)={(Wmax−Wmin)/Wmin}×100

(9) Appearance Quality of Fabric, Smoothness of Fabric, Color Fastness to Light, Durability and Overall Evaluation (i) Preparation of Raised Knitted Fabric for Evaluation The fibers obtained in each example or comparative example were used as both front yarns and back yarns, to prepare a knitted gray fabric of tricot half at 28G. The obtained gray fabric was scoured at 95° C. and preset at 140° C., being raised. Then, it was died at 130° C. and finish-set at 160° C. using a pin tenter, to obtain a raised knitted fabric.

(ii) Appearance Quality of Fabric and Smoothness of Fabric

The obtained raised knitted fabric was cut to obtain a 30 cm square piece. The knitted fabric piece was subjected to the following four-step sensory evaluation performed jointly by three evaluators with an experience of three or more years. Meanwhile, acceptable level is B or higher.

A: Very excellent

B: Excellent

C: Improved to some extent in effect compared with conventional product

D: Same as conventional product

The respective evaluations were performed in reference to the following matters.

Appearance quality of fabric: The projections and recesses on the surface of the fabric and the curling of the fabric were visually evaluated in comparison with a conventional product (3GT fibers of Comparative Example 7). A fabric smaller in the projections and recesses on the surface and curled less was evaluated to be more excellent and a fabric in which neither the projections/recesses on the surface nor curling was discernible was evaluated to be A. Smoothness of fabric: The softness and uniformity of the raising on a fabric were evaluated by touch in comparison with a conventional product (PET fibers of Comparative Example 9). A fabric with higher softness and more uniform smoothness was evaluated to be more excellent.

(iii) Color Fastness to Light

A strong energy xenon fade meter (SC700-1FA: produced by Suga Test Instruments Co., Ltd.) was used. A raised knitted fabric held between urethane sheets was fixed on a holder. The holder was mounted with a glass filter, and the fabric was irradiated with a xenon lamp using a black panel at a temperature of 73° C. and 50% RH for 3.8 hours. After completion of test, the grade of the sample was decided using a gray scale for discoloration fade in conformity with JIS L 0804. The acceptable level is B or higher.

A: Grade 4 or higher

B: Grade 3.5

C: Grade 3

D: Grade 2.5 or lower (iv) Durability

A raised knitted fabric was cut to obtain a 10 cm square piece, and it was fixed at the four corners and allowed to float at the central portion. A load with a sectional area of 4 $cm^2$ and a weight of 300 g was placed on the central portion and kept for 30 seconds. The weight was removed, and the fabric was allowed to stand for 30 seconds. The above mentioned loading and unloading were repeated 5 times in total, and the fabric was liberated and placed on a flat surface. It was visually evaluated by three evaluators with an experience of three or more years as described for the aforementioned (ii) in comparison with a conventional product (PET fibers of Comparative Example 9). A fabric with a less recess formed by loading was evaluated to be more excellent, and a fabric in which the recess was not visually discernible was evaluated to be A.

A: Very excellent

B: Excellent

C: Improved to some extent in effect compared with conventional product

D: Same as conventional product (v) After the abovementioned fabric evaluations, overall evaluation was performed. A fabric evaluated to be C in any one of the evaluation items was decided to be C in overall evaluation. A fabric evaluated to be B or higher in all the items and A in three items was decided to be A in overall evaluation. The other fabrics were decided to be B in overall evaluation. In the three-step evaluation, B or higher is acceptable.

A: Very excellent

B: Excellent

C: Not improved so much compared with conventional product

Examples 1 to 3 and Comparative Examples 1 to 3

Experiments of core-sheath fibers were performed. The polyesters used were as shown in Table 1, and the ratio between the core and the sheath was changed appropriately. In Example 1, 3GT homopolymer with an intrinsic viscosity of 1.1 was used as the sheath component, and PET homopolymer with an intrinsic viscosity of 0.51 was used as the core component. The core-sheath fibers were produced by spinning at a spinning temperature of 270° C. In this case, a publicly known die for core-sheath spinning was used to produce the core-sheath form at the die. Meanwhile, the retention time of 3GT from the entry into the pipe to the discharge from the die was 6 minutes, and that of PET was 50 minutes. The melt viscosity of 3GT measured under this condition was 1900 poises and that of PET was 480 poises.

The spinning equipment of FIG. 4 was used. Spinning was performed at a die face depth of 20 mm, and a spinning speed of 1600 m/min. The polymers discharged from a die 27 were cooled by a cooling device 28, to be transformed into fibers, and the fibers were bundled and subsequently oiled at an oiling device 29 installed at 1500 mm from the die face. Further, the fibers were entangled at an entangling device 30 and wound around a first roller 31 revolving at a speed of 1600 m/min. The first roller 31 was heated at 55° C. The fibers were wound around the first roller 31 seven turns and sent to a second roller 32 revolving at a speed of 4200 m/min, being drawn to 2.625 times. The second roller 32 was heated at 150° C. The fibers were wound around the second roller 32 six turns and heat-treated at 150° C. for $39\times10^{-3}$ second. After completion of heat treatment, the fibers were entangled again at an entangling device 33, sent to a third roller 34 and a fourth roller 35, for being cooled and adjusted in tension, and wound as a package 37 at 3990 m/min using a contact roller 36 and a winder 38, to obtain 48 filaments of 84 dtex as polyester fibers.

In Example 2 and Comparative Examples 1 and 2, fibers were produced as described in Example 1, except that polymers and the ratio between the core and the sheath were changed. Meanwhile, in Example 2, the retention time of 3GT was 7 minutes while the retention time of PET was 17 minutes, and in Comparative Example 1, the retention time of 3GT was 10 minutes while the retention time of PET was 10 minutes. In Comparative Example 2, the retention time of 3GT was 8 minutes while the retention time of PET was 14 minutes.

In Example 3, PBT homopolymer with an intrinsic viscosity of 0.78 was used as the core component, to obtain 48 filaments of 84 dtex as core-sheath fibers. Meanwhile, the retention time of 3GT was 7 minutes while the retention time of PBT was 17 minutes. Fibers were produced under the same conditions as in Example 1.

In Comparative Example 3, PBT homopolymer with an intrinsic viscosity of 0.78 was used as the sheath component and PET homopolymer with an intrinsic viscosity of 0.51 was used as the core component, to obtain core-sheath fibers. The retention time of PBT was 6 minutes while the retention time of PET was 50 minutes. The fibers were produced under the same conditions as in Example 1.

On the other hand, in Comparative Examples 1 and 2, since the properties of PET were dominant, the initial tensile resistivity and the elastic recovery rate after 20% elongation as the properties of 3GT vanished, though the self-shrinkage percentage was low, and satisfactory fabrics could not be obtained. Further, in Comparative Example 3, since PBT was used instead of 3GT, the initial tensile resistivity and the elastic recoverability were insufficient and especially only a fabric very poor in the durability evaluated after repeated loads could be obtained.

TABLE 1

| | | Example 1 | Example 2 | Comparative Example 1 | Comparative Example 2 | Example 3 | Comparative Example 3 |
|---|---|---|---|---|---|---|---|
| First component | Polymer | 3GT | 3GT | 3GT | 3GT | 3GT | PBT |
| | Intrinsic viscosity [η] | 1.1 | 1.1 | 1.1 | 0.80 | 1.1 | 0.78 |
| | Retention time (min) | 6 | 7 | 10 | 8 | 7 | 6 |
| | Melt viscosity (poises) | 1900 | 1850 | 1680 | 650 | 1850 | 750 |
| Second component | Polymer | PET | PET | PET | PET | PBT | PET |
| | Intrinsic viscosity [η] | 0.51 | 0.51 | 0.51 | 0.65 | 0.78 | 0.51 |
| | Retention time (min) | 50 | 17 | 10 | 14 | 17 | 50 |
| | Melt viscosity (poises) | 480 | 520 | 530 | 1020 | 630 | 480 |
| Conjugation ratio (first component:second component) (ratio by mass) | | 90:10 | 70:30 | 50:50 | 64:36 | 70:30 | 90:10 |
| Initial tensile resistivity (cN/dtex) | | 26 | 33 | 45 | 52 | 25 | 45 |
| Self-shrinkage percentage after dry heat treatment at 160° C. (%) | | 1.4 | 1.1 | 0.7 | 0.4 | 1.2 | 0.9 |
| Elastic recoverability after 20% elongation (%) | | 95 | 90 | 65 | 47 | 82 | 40 |
| Boiling water shrinkage percentage (%) | | 10.3 | 9.2 | 8.2 | 7.3 | 8.5 | 9.1 |
| Dry heat shrinkage percentage (%) | | 14.2 | 13.7 | 10.0 | 9.8 | 12.0 | 11.9 |
| Shrinkage stress | Temperature at stress of 0.05 cN/dtex (° C.) | 56 | 70 | 78 | 75 | 63 | 72 |
| | Peak temperature (° C.) | 148 | 148 | 151 | 147 | 148 | 147 |
| | Peak stress (cN/dtex) | 0.24 | 0.23 | 0.23 | 0.22 | 0.23 | 0.20 |
| Tenacity (cN/dtex) | | 3.3 | 3.2 | 3.5 | 3.9 | 3.3 | 3.5 |
| Elongation (%) | | 42 | 42 | 41 | 36 | 42 | 40 |
| Package | Bulge (%) | 6 | 5 | 4 | 4 | 6 | 4 |
| | Saddle (%) | 5 | 2 | 2 | 3 | 3 | 2 |
| Appearance quality of fabric | | B | A | A | A | B | A |
| Smoothness of fabric | | A | B | D | D | A | D |
| Color fastness to light | | B | A | B | C | B | B |
| Durability | | A | A | C | C | B | C |
| Overall evaluation | | B | A | C | C | B | C |

The production conditions and results are shown in Table 1. Examples 1 to 3 satisfied the ranges of this invention in the initial tensile resistivity, the elastic recovery rate after 20% elongation and the self-shrinkage percentage after dry heat treatment at 160° C., and good results were obtained also in the evaluations of the respective fabrics. Especially in Example 2, the balance among the initial tensile resistivity, the elastic recovery rate after 20% elongation and the self-shrinkage percentage after dry heat treatment at 160° C. was best, and an especially excellent raised knitted fabric could be obtained. Further, PET or PBT with good color fastness to light was conjugated as the core, the core-sheath fibers as a whole were improved in the color fastness to light.

Examples 4 to 6 and Comparative Example 4

Next, experiments were performed to find the effects of the spinning speed and the heat treatment temperature on core-sheath fibers. The other conditions than the spinning speed and the heat treatment temperature were the same as in Example 2. The production conditions and results are shown in Table 2.

In Examples 4 to 6 in which the spinning speed was in the range of this invention, both the thermosetting property and the softness could be satisfactory, and fabrics good in the elastic recoverability could be obtained. On the other hand, in Comparative Example 4 in which the spinning speed was 1000 m/min, since the self-shrinkage percentage after dry heat treatment at 160° C. was as high as 1.6%, only a fabric poor in surface appearance quality could be obtained.

TABLE 2

| | | Example 2 | Example 4 | Example 5 | Example 6 | Comparative Example 4 |
|---|---|---|---|---|---|---|
| Speed of first roll (m/min) | | 1600 | 1400 | 2000 | 3500 | 1000 |
| Speed of second roll (m/min) | | 4200 | 3700 | 4800 | 5200 | 3300 |
| Temperature of second roll (° C.) | | 150 | 120 | 160 | 180 | 150 |
| Winding speed (m/min) | | 3990 | 3540 | 4460 | 4780 | 3200 |
| Initial tensile resistivity (cN/dtex) | | 33 | 33 | 34 | 31 | 35 |
| Self-shrinkage percentage after dry heat treatment at 160° C. (%) | | 1.1 | 1.4 | 1.1 | 1.0 | 1.6 |
| Elastic recoverability after 20% elongation (%) | | 90 | 87 | 89 | 88 | 92 |
| Boiling water shrinkage percentage (%) | | 9.2 | 10.3 | 9.1 | 7.9 | 12.1 |
| Dry heat shrinkage percentage (%) | | 13.7 | 14.4 | 13.5 | 12.0 | 15.9 |
| Shrinkage stress | Temperature at stress of 0.05 cN/dtex (° C.) | 70 | 59 | 70 | 73 | 52 |
| | Peak temperature (° C.) | 148 | 130 | 161 | 174 | 145 |
| | Peak stress (cN/dtex) | 0.23 | 0.25 | 0.22 | 0.18 | 0.28 |
| Tenacity (cN/dtex) | | 3.2 | 3.4 | 3.1 | 3.0 | 3.6 |
| Elongation (%) | | 42 | 39 | 43 | 46 | 40 |
| Package | Bulge (%) | 5 | 8 | 5 | 3 | 12 |
| | Saddle (%) | 2 | 4 | 2 | 2 | 6 |
| Appearance quality of fabric | | A | B | A | A | C |
| Smoothness of fabric | | B | B | B | B | B |
| Color fastness to light | | A | A | B | B | A |
| Durability | | A | A | A | A | A |
| Overall evaluation | | A | B | B | B | C |

Examples 7 to 10 and Comparative Examples 5 and 6

Next, experiments of blended fibers were performed. The polyesters used and the retention times in the die were as shown in Table 3. Forty eight filaments of 84 dtex were obtained as blended fibers at the same temperature conditions and speed conditions as in Example 1, except that a different die was used and that a mixture obtained by kneading two polymers in a mixer was discharged to make blended fibers. The production conditions and results are shown in Table 3.

It can be seen from the comparison between Example 1 and Comparative Example 5 that the properties of 3GT remain more in blended fibers than in core-sheath fibers even if the polymer mixing ratio is the same. In Comparative Example 5, since the loaded shrinkage rate was high, the projections and recesses of the fabric were conspicuous and did not allow the practical use of the fabric. In Comparative Example 6, since the PET rate was higher, the initial tensile resistivity and the elastic recovery rate were poor, and only a fabric poor in softness and durability could be obtained.

On the contrary, in Examples 7 to 10, the self-shrinkage percentage could be successfully decreased while the features of 3GT could be maintained, and excellent raised knitted fabrics could be obtained.

TABLE 3

| | | Comparative Example 5 | Example 7 | Example 8 | Comparative Example 6 | Example 9 | Example 10 |
|---|---|---|---|---|---|---|---|
| First component | Polymer | 3GT | 3GT | 3GT | 3GT | 3GT | 3GT |
| | Intrinsic viscosity [η] | 1.1 | 1.1 | 1.1 | 1.1 | 1.1 | 1.1 |
| | Retention time (min) | 6 | 6 | 8 | 13 | 6 | 7 |
| | Melt viscosity (poises) | 1900 | 1900 | 1810 | 1580 | 1900 | 1850 |
| Second component | Polymer | PET | PET | PET | PET | PET | PBT |
| | Intrinsic viscosity [η] | 0.51 | 0.51 | 0.51 | 0.51 | 0.65 | 0.78 |
| | Retention time (min) | 50 | 25 | 13 | 8 | 50 | 17 |
| | Melt viscosity (poises) | 480 | 490 | 530 | 540 | 890 | 630 |
| Blend ratio (first component:second component) (ratio by mass) | | 90:10 | 80:20 | 60:40 | 40:60 | 90:10 | 70:30 |
| Initial tensile resistivity (cN/dtex) | | 22 | 25 | 26 | 68 | 24 | 23 |

TABLE 3-continued

| | | Comparative Example 5 | Example 7 | Example 8 | Comparative Example 6 | Example 9 | Example 10 |
|---|---|---|---|---|---|---|---|
| Self-shrinkage percentage after dry heat treatment at 160° C. (%) | | 1.7 | 1.4 | 1.1 | 0.8 | 1.3 | 1.4 |
| Elastic recoverability after 20% elongation (%) | | 97 | 95 | 96 | 53 | 92 | 95 |
| Boiling water shrinkage percentage (%) | | 11.9 | 11.2 | 9.5 | 6.8 | 10.8 | 10.8 |
| Dry heat shrinkage percentage (%) | | 15.6 | 15.6 | 11.9 | 9.5 | 13.2 | 14.2 |
| Shrinkage stress | Temperature at stress of 0.05 cN/dtex (° C.) | 45 | 53 | 63 | 72 | 57 | 60 |
| | Peak temperature (° C.) | 149 | 148 | 150 | 148 | 143 | 149 |
| | Peak stress (cN/dtex) | 0.27 | 0.27 | 0.22 | 0.19 | 0.24 | 0.24 |
| Tenacity (cN/dtex) | | 3.4 | 3.3 | 3.5 | 4.0 | 3.4 | 3.2 |
| Elongation (%) | | 45 | 44 | 40 | 35 | 42 | 42 |
| Package | Bulge (%) | 8 | 6 | 4 | 4 | 6 | 6 |
| | Saddle (%) | 5 | 3 | 2 | 2 | 3 | 4 |
| Appearance quality of fabric | | D | B | B | A | B | B |
| Smoothness of fabric | | A | A | B | D | A | B |
| Color fastness to light | | C | B | A | A | B | B |
| Durability | | B | A | A | D | B | A |
| Overall evaluation | | C | B | B | C | B | B |

Examples 11 and 12 and Comparative Examples 7 to 9

Figure 2:
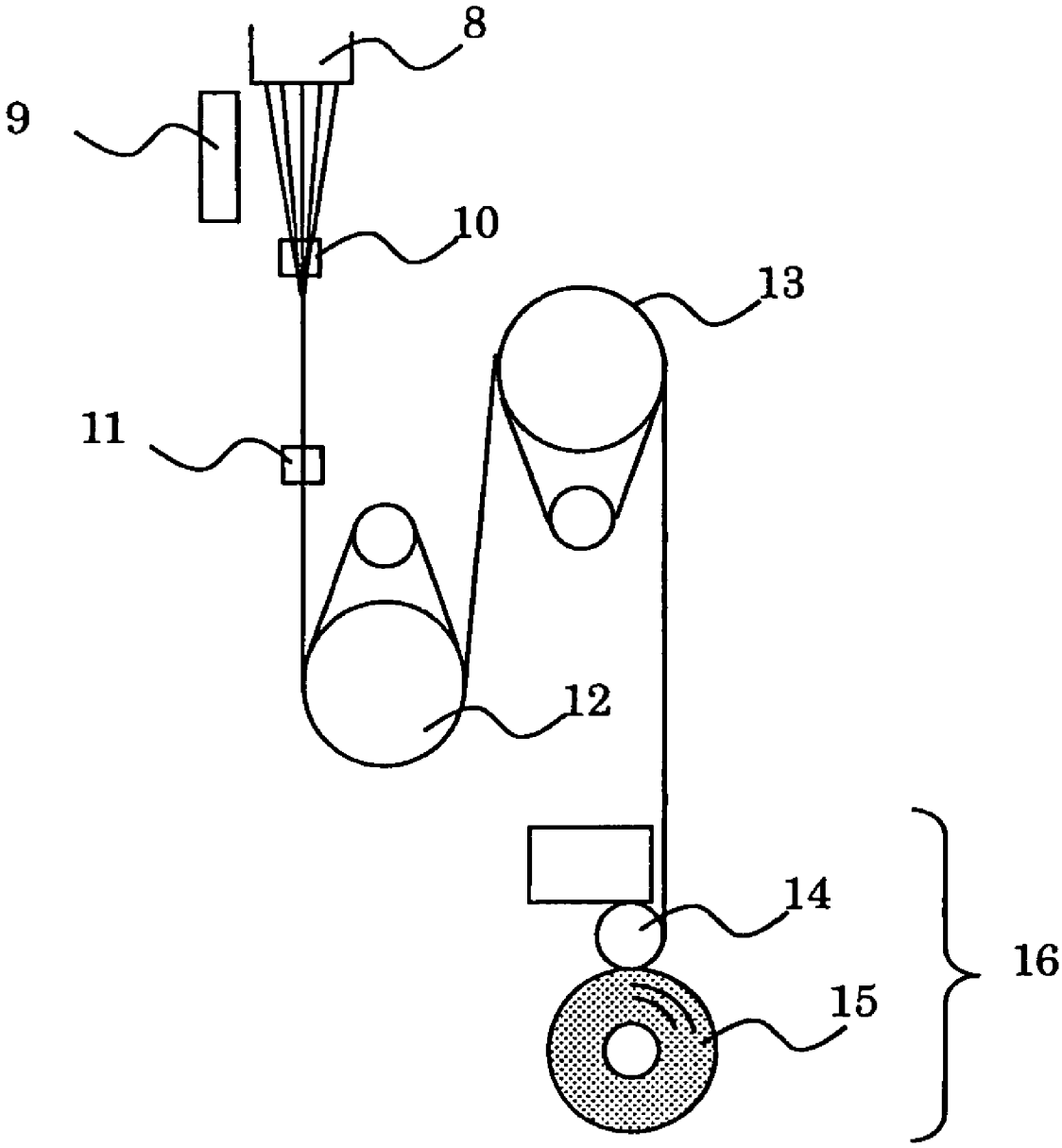
[FIG. 2] is a drawing showing a preferred example of equipment for producing 3GT fibers.

Next, experiments of 3GT fibers were performed. In Example 11, 3GT homopolymer with an intrinsic viscosity of 1.1 was used, and spinning was performed at a spinning temperature of 250° C. The retention time in the die was 10 minutes. The die face depth was set at 20 mm, and the equipment of FIG. 2 was used for producing fibers. At first, the polymer discharged from a die 8 was cooled by a cooling device 9, oiled by an oiling device 10, entangled by an entangling device 11 and then wound around a first roller 12 revolving at a speed of 5000 m/min. The first roller 12 was not heated and had a surface temperature of 35° C. After the fibers were wound around the first roller 12 seven turns, they were sent to a second roller 13 revolving at a speed of 5000 m/min. The second roller 13 was heated at 150° C. The fibers were wound around the second roller 13 six turns and heat-treated at 150° C. for $32\times10^{-3}$ second. After completion of heat treatment, the fibers were wound as a package 15 at 4850 m/min using a contact roll 14 and a winder 16, to obtain 48 filaments of 84 dtex as polyester fibers.

Also in Example 12, fibers were produced as described in Example 11 and wound with the speeds of the first roller 12 and the second roller 13 set at 6000 m/min and 5800 m/min respectively, to obtain 48 filaments of 84 dtex as polyester fibers.

In Comparative Example 7, the same polymer as used in Example 11 was used, but the first roller 12 was heated at 55° C. and revolved at a speed of 3000 m/min, and the fibers were drawn to 1.33 times between the first roller 12 and a second roller 13 revolving at 4000 min. At the second roller 10, heat treatment was performed at 150° C., and the fibers were wound at 3800 m/min, to obtain 48 filaments of 84 dtex as polyester fibers.

In Comparative Example 8, spinning was performed as described in Example 11, except that the second roller was not heated.

In Comparative Example 9, an experiment was performed as described in Example 11, except that PET homopolymer with an intrinsic viscosity of 0.65 was used, that the spinning temperature was 290° C., and that the heat treatment at the second roller 13 was not performed.

The production conditions and results are shown in Table 4. In Examples 11 and 12, good fabrics could be obtained. On the contrary, in Comparative Example 7 in which drawing was performed, the self-shrinkage percentage was high, and the fabric declined in appearance quality. In addition, only fibers poor in package form could be obtained. Further, in Comparative Example 8, fibers were produced under the conditions similar to those of the examples of JP2001-348729A. The self-shrinkage percentage was suppressed insufficiently, and only fibers poor in package form could be obtained. Further, in Comparative Example 9 using PET, only a fabric poor in softness and durability could be obtained.

TABLE 4

| | | Example 11 | Example 12 | Comparative Example 7 | Comparative Example 8 | Comparative Example 9 |
|---|---|---|---|---|---|---|
| First component | Polymer | 3GT | 3GT | 3GT | 3GT | PET |
| | Intrinsic viscosity (poises) | 1.1 | 1.1 | 1.1 | 1.1 | 0.65 |
| | Retention time (min) | 10 | 8 | 13 | 10 | 10 |
| | Melt viscosity (poises) | 1680 | 1810 | 1580 | 1680 | 1080 |

TABLE 4-continued

| | | Example 11 | Example 12 | Comparative Example 7 | Comparative Example 8 | Comparative Example 9 |
|---|---|---|---|---|---|---|
| Speed of first roll (m/min) | | 5000 | 6000 | 3000 | 5000 | 5000 |
| Temperature of first roll (° C.) | | Not heated | Not heated | 55 | Not heated | Not heated |
| Speed of second roll (m/min) | | 5000 | 5800 | 4000 | 5000 | 5000 |
| Temperature of second roll (° C.) | | 150 | 150 | 150 | Not heated | Not heated |
| Heat treatment time ($\times 10^{-3}$ second) | | 32 | 28 | 40 | 0 | 0 |
| Initial tensile resistivity (cN/dtex) | | 19 | 19 | 18 | 17 | 91 |
| Self-shrinkage percentage after dry heat treatment at 160° C. (%) | | 1.4 | 1.2 | 1.8 | 1.7 | 0.3 |
| Elastic recoverability after 20% elongation (%) | | 99 | 99 | 99 | 99 | 37 |
| Boiling water shrinkage percentage (%) | | 5.8 | 5.4 | 11.2 | 6.3 | 2.7 |
| Dry heat shrinkage percentage (%) | | 6.0 | 5.7 | 15.2 | 7.2 | 3.2 |
| Shrinkage stress | Temperature at stress of 0.05 cN/dtex (° C.) | 58 | 60 | 47 | 48 | 68 |
| | Peak temperature (° C.) | 140 | 138 | 142 | 96 | 95 |
| | Peak stress (cN/dtex) | 0.18 | 0.16 | 0.29 | 0.20 | 0.13 |
| Tenacity (cN/dtex) | | 2.8 | 3.0 | 3.2 | 2.8 | 3.7 |
| Elongation (%) | | 58 | 54 | 53 | 56 | 50 |
| Package | Bulge (%) | 6 | 8 | 12 | 13 | 5 |
| | Saddle (%) | 7 | 8 | 13 | 11 | 8 |
| Appearance quality of fabric | | B | B | D | D | A |
| Smoothness of fabric | | A | A | A | A | D |
| Color fastness to light | | B | B | D | D | A |
| Durability | | A | A | A | A | D |
| Overall evaluation | | B | B | C | C | C |

Examples 13 and 14 and Comparative Example 10

Experiments were performed to find the effects of die face depth. Fabrics were obtained using the same polymers as those of Example 2 with the spinning temperature, spinning speed and other temperature conditions etc. set as described in Example 2, and with the die face depth changed from 20 mm of Example 2 to 60 mm, 90 mm and 110 mm. The fabrics were evaluated and the results are shown in Table 5. In Example 13 with the die face depth set at 60 mm, an excellent fabric like that of Example 2 could be obtained. Further, also in Example 14 with the die face depth set at 90 mm, a sufficiently excellent fabric could be obtained. However, in Comparative Example 10 with the die face depth set at 110 mm, only a fabric conspicuous in projections and recessions and poor in color fastness to light could be obtained since the boiling water shrinkage percentage and the dry heat shrinkage percentage were high while the self-shrinkage percentage was 1.6%, though the tenacity was enhanced.

Example 15 and Comparative Example 11

Further, fabrics were obtained using the same polymer as that of Example 12 with the spinning temperature, spinning speed and other temperature conditions etc. set as described in Example 12, and with the die face depth only changed from 20 mm of Example 12 to 90 mm and 110 mm. The fabrics were evaluated and the results are shown in Table 5. In Example 15 with the die face depth set at 90 mm, an excellent fabric like that of Example 11 could be obtained. However, in Comparative Example 11 with the die face depth set at 110 mm, a satisfactory fabric could not be obtained, since the self-shrinkage percentage after dry heat treatment at 160° C. was high, though the tenacity was enhanced.

TABLE 5

| | Example 2 | Example 13 | Example 14 | Comparative Example 10 | Example 12 | Example 15 | Comparative Example 11 |
|---|---|---|---|---|---|---|---|
| Die face depth (mm) | 20 | 60 | 90 | 110 | 20 | 90 | 110 |
| Initial tensile resistivity (cN/dtex) | 33 | 34 | 32 | 32 | 19 | 18 | 18 |
| Self-shrinkage percentage after dry heat treatment at 160° C. (%) | 1.1 | 1.3 | 1.4 | 1.6 | 1.2 | 1.4 | 1.8 |
| Elastic recoverability after 20% elongation (%) | 90 | 90 | 91 | 93 | 99 | 99 | 99 |
| Boiling water shrinkage percentage (%) | 9.2 | 9.6 | 10.6 | 11.2 | 5.4 | 6.3 | 6.5 |

TABLE 5-continued

| | | Example 2 | Example 13 | Example 14 | Comparative Example 10 | Example 12 | Example 15 | Comparative Example 11 |
|---|---|---|---|---|---|---|---|---|
| Dry heat shrinkage percentage (%) | | 13.7 | 13.9 | 14.0 | 14.5 | 5.7 | 7.8 | 7.8 |
| Shrinkage stress | Temperature at stress of 0.05 cN/dtex (° C.) | 70 | 65 | 56 | 51 | 60 | 55 | 53 |
| | Peak temperature (° C.) | 148 | 149 | 149 | 147 | 138 | 140 | 139 |
| | Peak stress (cN/dtex) | 0.23 | 0.23 | 0.25 | 0.25 | 0.16 | 0.18 | 0.19 |
| Tenacity (cN/dtex) | | 3.2 | 3.4 | 3.5 | 3.6 | 3.0 | 3.1 | 3.4 |
| Elongation (%) | | 42 | 44 | 42 | 45 | 54 | 55 | 53 |
| Package | Bulge (%) | 5 | 6 | 6 | 11 | 8 | 10 | 10 |
| | Saddle (%) | 2 | 2 | 4 | 8 | 8 | 8 | 8 |
| Surface quality of fabric | | A | A | B | D | B | B | D |
| Smoothness of fabric | | B | B | B | B | A | A | A |
| Color fastness to light | | A | A | B | C | B | B | D |
| Durability | | A | A | A | A | A | A | A |
| Overall evaluation | | A | A | B | C | B | B | C |

Industrial Applicability

The polyester fibers of this invention are suitable for a woven or knitted fabric. The polyester fibers of this invention can be used to obtain a woven or knitted fabric resistant against repeated loads, excellent in surface softness and uniformity, and free from projections/recesses and curling. Since the woven or knitted fabric obtained from the polyester fibers of this invention is highly resistant against repeated loads, it can be suitably used as a car seat loaded with human bodies. Meanwhile, the car seat may be raised so that it can look luxurious. Since the polyester fibers of this invention are low in the initial tensile resistivity, the fabric obtained from them and raised is excellent in softness. Meanwhile, a raised fabric is likely to have the problems of curling and the like since the front surface and the back surface are different in state. However, since the polyester fibers of this invention are low in the self-shrinkage percentage after dry heat treatment at 160° C., the fabric obtained from the fibers is less curled even if it is raised. In this sense, the polyester fibers of this invention and the fabric obtained from them are the fibers and fabric most desired in the automobile industry.

The invention claimed is:

1. A concentric core-sheath conjugate polyester fiber comprising a sheath formed of polytrimethylene terephthalate having an intrinsic viscosity of 0.8 to 1.2 and a core formed of polyethylene terephthalate having an intrinsic viscosity of 0.4 to 0.6, said fiber having an initial tensile resistivity of 15 to 33 cN/dtex, an elastic recovery rate of 70% or more after 20% elongation, and a self-shrinkage percentage of 0.3% to 1.4% after dry heat treatment at 160° C.

2. A woven or knitted fabric comprising the fibers as set forth in claim 1.

3. A woven or knitted fabric consisting of the fibers as set forth in claim 1.

4. A car seat formed of the woven or knitted fabric as set forth in claim 2.

5. A car seat as set forth in claim 4, which is raised.

6. A cheese-shaped package having the fibers as set forth in any one of claim 1 wound therearound, with a bulge of −5 to 10% and a saddle of 0 to 10%.

7. A process for producing polyester fibers as set forth in claim 1, comprising melting polytrimethylene terephthalate polymer, discharging the polymer from a die with a die face depth of 20 to 90 mm, taking up the discharged polymer at a spinning speed of 4500 to 7000 m/min, and heat-treating the taken up fibers at 120 to 180° C. without drawing.

8. A process for producing polyester fibers, according to claim 7, wherein said heat treatment is tension heat treatment.

* * * * *